United States Patent [19]

Juvonen et al.

[11] 3,965,799

[45] June 29, 1976

[54] HYDRAULICALLY OPERATED PERCUSSION DEVICE

[75] Inventors: Esko Juvonen; Pentti Virtanen, both of Lahti, Finland

[73] Assignee: Roxon Oy, Messilantie, Finland

[22] Filed: Sept. 11, 1974

[21] Appl. No.: 505,028

[30] Foreign Application Priority Data

Sept. 14, 1973 Finland ..... 2866/73

[52] U.S. Cl. ..... 91/220; 91/276; 91/300; 91/320; 91/321

[51] Int. Cl.[2] ..... F01B 25/04; F01L 17/00; F01L 25/04; F01B 7/18

[58] Field of Search ..... 91/276, 328, 300, 321, 91/309, 320, 220

[56] References Cited

UNITED STATES PATENTS

| | | | |
|---|---|---|---|
| 1,895,153 | 1/1933 | Feucht | 91/300 |
| 2,426,409 | 8/1947 | Farrell | 91/300 |
| 3,774,502 | 11/1973 | Arndt | 91/300 |

FOREIGN PATENTS OR APPLICATIONS

| | | | |
|---|---|---|---|
| 651,732 | 11/1962 | Canada | 91/300 |

*Primary Examiner*—Paul E. Maslousky
*Attorney, Agent, or Firm*—Darby & Darby

[57] ABSTRACT

Hydraulically driven percussion device, comprising a piston reciprocally movable within a body and striking against a tool, said piston defining with reference to the body two cylinder spaces, one of which continuously communicates with the high pressure duct and the other by the aid of a distribution means alternatingly connectable to the high pressure duct and the low pressure duct. At both ends of the piston there are breathing chambers opening into the free atmosphere. Within one of said two cylinder spaces a sleeve-like distribution means has been placed to encircle the piston and which distribution means, in order to move into a position such that movement of the piston directed towards the tool becomes possible, is controlled by means of grooves provided in the piston and in the body when the piston is in its end position farthest removed from the tool and only on condition that the pressure in the high pressure duct exceeds a pressure set with an adjustable valve incorporated in the body.

2 Claims, 1 Drawing Figure

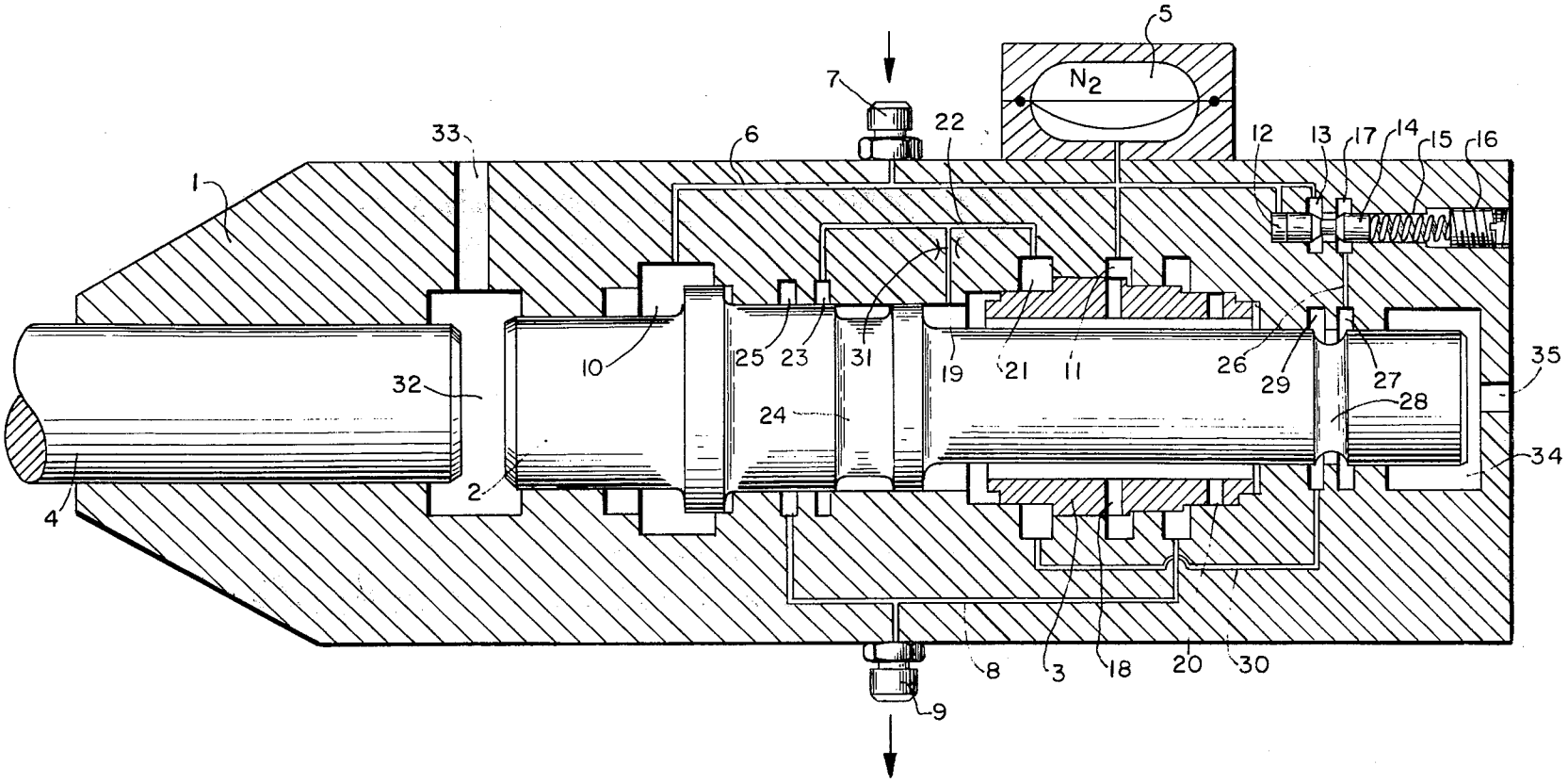
35
34
16
15
14
17
13
12
5
$N_2$
22
7
6
33
1
4
32
2
10
25
23
24
31
19
21
11
26
29
27
28
30
20
18
3
8
9

HYDRAULICALLY OPERATED PERCUSSION DEVICE

The present invention concerns a percussion device wherein a hydraulically driven reciprocating piston delivers consecutive impacts, by operation of a tool, against the object to be worked, which may be of stone, concrete, asphalt, frozen soil or equivalent. The device according to the invention may also be employed as a percussion mechanism of a rock drill, and in riveting, hammering, pile driving and tamping work, etc.

For use in the said kinds of work in recent time in the field of pneumatic percussion devices a grat number of hydraulic percussion devices have been developed, owing to the economy of hydraulic operation and to the simplicity of the driving apparatus. When hydraulic devices are introduced instead of pneumatic ones, the big and expensive compressor may be altogether omitted, which results in considerable monetary savings in initial and operating costs as well as greater mobility of the equipment in the terrain.

It is a fact, however, that only very few of the numerous hydraulic percussion machine quite recently developed have proved to be fit for use in actual practice and durable enough as regards their construction. The greatest difficulties encountered in them are associated with:

- cavitation
- the liquid distribution means, which should direct pressure against the percussion piston to produce a fast enough movement
- starting of the percussion device in all and any of the positions of its piston and distribution means
- control of the distribution means in accordance with the piston movements
- preservation of the impact energy under variable conditions.

For a closer consideration of these difficulties, the operation of percussion devices shall be clarified in general.

By conducting pressurized oil in a desired manner into cylinder spaces defined by the machine body on one hand and by the surfaces of the freely moving piston on the other hand, the piston can be made to move reciprocally by the force effect derived from hydrostatic pressure. When the percussion piston moves in the direction towards the tool, this is called the impact movement, and when it moves in the opposite direction, this is referred to as the return movement. In the impact movement of the piston the hydraulic pressure energy is converted into kinetic energy of the piston, which at the abrupt impact of the piston against the tool is transferred in the form of a stress wave propagated along the latter, to the object. This causes between the edge of the tool and the object a momentary force effect of such magnitude that the object breaks up. A part of the stress wave is reflected, imparting to the piston in the direction of the return movement a small initial velocity, the so-called rebound velocity. In this manner the combination of the tool and object, e.g. a rock, may be thought of as a kind of gentle spring, against which the piston works. Depending on different materials, inhomogeneity, etc., the properties of the imagined spring vary in a random way, causing changes of the duration of the impact and of the rebound velocity of the piston. Because of this the stroke length of the piston and its stroke frequency, which is understood to be the number of impacts delivered per unit time, vary continuously. For this reason a hydraulic percussion mechanism system in which the means governing the distribution means is independent of the piston movements is not very successful.

In most of the arrangements in which it has been possible to avoid the drawback mentioned, the distribution means has been controlled from the piston movements, whereby the variations of stroke length and stroke frequency do not interfere with the operation of the machine. It is obvious, however, that changes of the stroke length are also naturally accompanied by changes of the machine's impact energy. Furthermore there is a risk that with increasing stroke frequency the pressure in the hydraulic system may go down, whereby the impact energy is strongly reduced. In some arrangements these drawbacks could be avoided by making the stroke length of the machine constant, in which case, again, it has been necessary to use distribution means causing the high pressure circuit to be directly open into the low pressure circuit during a certain period. The results in major pressure fluctuations and a poor efficiency. From the great pressure fluctuations follows a risk of damage not only to the percussion machine itself but also to other equipment in the same hydraulic circuit. Those devices in which the great pressure fluctuations have been eliminated have required designs involving a risk of cavitation. Cavitation occurs when the pressure momentarily decreases to full vacuum level in the high or low pressure circuit when the percussion piston moves too fast compared with the rate of oil flow. As a rule, cavitation is due to the circumstance that the flow passages are too small compared with the action area of the pressure accelerating the piston. It is advantageous in view of preventing cavitation if there is no flow of the liquid from the low pressure circuit, or from the so-called return passage, back into cylinder spaces associated with the percussion piston, during the impact movement of the piston. If, again, the flow is directed during the impact movement from the cylinder spaces in the direction of the return passage, then difficulties are also encountered because the high flow resistance cause pressure drops and excessive heating of the oil.

If the percussion device is intended to be used as a percussion unit in a rock drill, difficulties are particularly encountered in conducting the flushing fluid, which usually is pressurized water or air, into the tool — in this case a drill rod. It is usual practice in prior art pneumatic rock drills to conduct the flushing fluid from the rear part of the machine by a pipe passing through the piston, into the drill rod. No special sealing problems are encountered in pneumatic equipment between the flushing pipe and the cylinder spaces of the percussion piston, and even if there should be leakage this would not have any great significance because the leaking substance would be air. In hydraulic equipment, however, great sealing difficulties are a fact with regard to the flusing pipe, owing to the rather much higher pressures and to the fact that the pressure fluid is now oil.

One of the disadvantages observed in prior art hydraulic percussion devices is associated with the starting of the machine, and it arises from the fact that after the machine has stopped and the pressure removed from the system the percussion piston and distribution means may move by gravity effect into positions in which the machine is unable to start.

In the device according to the present invention the drawbacks mentiond have been avoided by introducing the following features.

The percussion piston is of the differential piston type. This means that the cylinder space in which the pressure is operative when the piston moves in the impact direction is then by virtue of the distribution means connected with the high pressure circuit, and when the piston moves in the return direction it is connected with the low pressure circuit. A second cylinder space, which has a smaller pressure action area, is continuously connected with the high pressure circuit. When the piston is moving in the impact direction the oil flows from this second cylinder space into the first-mentioned cylinder space. Since the low pressure circuit is cut off from the cylinder spaces during the impact movement, the cavitation phenomenon is avoided. Excessive pressure drops have been avoided by designing the distribution means to consist of a sleeve-like unit encircling the percussion piston. Such a sleeve-like unit has wide flow passages as a consequence of its comparatively extensive circumference, while at the same time the axial range of movement is very short, which is an advantage in view of small enough delay periods. The smaller stroke length of the distribution means also improves the overall efficiency of the device.

The sleeve-like distribution means also allows the use of a piston breathing at both ends, which is understood to mean that both ends of the percussion piston are moving in spaces immediately communicating with the free atmosphere. Furthermore, the control flow passage conducting pressure to the distribution means for the purpose of inducing the impact motion of the piston is guarded by an adjustable overflow valve so that the said control passage is only open if the pressure prevailing in the high pressure circuit exceeds a given pressure that has been set. This ensures that before the motion in the impact direction may start the piston has to be in a certain predetermined position, that is, it ensures that the stroke length has the correct value and the pressure is high enough. This is highly valuable in making the impact energy of the machine constant when the machine is used not only in connection with the working of different materials, but also when the viscosity of the oil changes by effect of ambient temperature or prolonged use, and when in the course of the gradual wearing out of machine components the internal leakage increases.

Like the piston, the sleeve-like distribution means has also been designed as a differential action unit so that the smaller area on one side is continuously open to the high pressure circuit and the larger area on the opposite side is controlled in the manner described, to connect alternatingly with the pressure circuit and with the low pressure circuit. In order to ensure that the machine starts without fail, the last-mentioned variable pressure chamber of the distribution means has been constructed to communicate by a throttled passage with the variable pressure cylinder space of the percussion piston.

The invention is described in closer detail in following by the aid of embodiment examples and with reference to the drawings.

FIG. 1 presents, in longitudinal section, a percussion device according to the invention, which is used to break up stone, concrete, asphalt, frozen soil, etc.

The device comprises a body 1 and therewithin a reciprocally movable percussion piston 2, a reciprocally movable sleeve-like distribution means 3 placed to encircle the percussion piston, and a tool 4, against which the percussion piston hits, fitted on one end of the body. The device further comprises a pressure accumulator 5, which is connected to communicate immediately with the high pressure duct 6. The use of a pressure accumulator to smooth oil flows and pressure fluctuations is known in prior art. Here, the principal task of the pressure accumulator is to supply fluid into the high pressure circuit during the rapid impact movement of the piston.

The pressurised liquid is supplied to the high pressure duct 6 through a tube connector 7. In order to vent the liquid away from the machine, a low pressure duct 8 has been provided in the body and to which a tube connector 9 has been connected. The high pressure duct 6 leads, apart from the pressure accumulator 5 mentioned, also to the front cylinder space 10 provided in association with the piston 2 and to the cylinder space 11 provided in association with the distribution means 3. Furthermore, the pressure duct 6 leads to the cylinder space 12 and groove 13 of the pressure guard valve fitted within the body 1. The pressure guard valve moreover comprises the spindle 14, spring 15, spring force setting screw 16, and the groove 17 beside the groove 13. The distribution means 3 has been machined to present apertures 18, which open on one hand into the said cylinder space 11 when the distribution means has moved at least through half of its travel in the direction of the return movement of the piston and on the other hand, independent of the position of the distribution means, into the rear cylinder space 19 provided in association with the piston 2. In the cylinder space 19 the pressure action area with regard to the piston has been made comparatively larger than in the cylinder space 10. It follows that when the high pressure becomes connected with the cylinder space 19, a force accelerating the piston 2 in the impact direction is created. When the cylinder space 19 communicates with the low pressure duct 8 by the openings 20 provided in the distribution means, the action of the pressure prevailing in the cylinder space 10 gives rise to a force in the return direction of the piston, whereby the piston will move in the return direction and the liquid will flow out from the cylinder space 19. The apertures 20 may open for passage of fluid as soon as the distribution means has moved in the direction of the piston's impact movement through at least half of its travel, whereby the apertures conducting the high pressure, 18, have closed. In order to move the distribution means from one end position to the other, a cylinder space 21 has been provided in association with the distribution means, this cylinder space featuring a pressure action area with regard to the distribution means which is larger than the corresponding area in the cylinder space 11. As a result, when the high pressure is connected to the cylinder space 21 the distribution means tends to move in the piston return direction, and when the low pressure is connected to the cylinder space 21 the distribution means tends, under influence of the pressure in the cylinder space 11, to move in the direction of the piston's impact movement.

In order to connect the cylinder space 21 with the low pressure circuit, a passage 22 leads from it to a groove 23 machined radially in the body to encircle the piston, and which groove 23 is connected by a groove 24 machined in the piston with another groove 25 in the body if the piston is located close enough to the tool 4. The groove 25 communicates directly with the low pressure duct 8. In order to connect the high pressure to the cylinder space 21, from the high pressure duct 6 over the pressure guard valve a duct 26 leads from the groove 17 of said valve to the groove 27 radially machined in the body around the piston, and which groove 27 is connected by a groove 28 provided in the piston with the groove 29 machined in the body adjacent to the groove 27, provided that the piston is in its rearmost position, or at the end of its return movement. The groove 29 has been connected with the cylinder space 21 by the passage 30. The communication between the grooves 13 and 17 of the pressure guard valve opens when the reduced diameter portion provided on the spindle coincides with the two grooves 13 and 17. The valve spring 15 tends to shut this communication off, while the pressure in the cylinder space 12 tends to open it. This results in the action that the displacement of the distribution means into a position such that the impact movement may begin depends, on one hand, on whether the piston is in its position farthest from the tool and on the other hand on whether the pressure in the high pressure duct is at the desired value.

The quantity of liquid supplied into the machine corresponds to a certain number of impacts executed by the machine, the impact energy of each blow being constant and dependent on the pressure adjusted by the screw 16. It is thus understood that the impact energy of the machine does not change appreciably when the resiliency characteristics of the material worked on, the conditions of operation or the characteristics of the pressure fluid change, nor as a result of wear of components with increasing age of the machine.

In order to ensure the desired position of the distribution means 3 and the starting ability of the machine, the cylinder space 21 is connected with the cylinder space 19 by a throttle element 31 branching off from the passage 22. During the operation of the machine, when the piston moves between its end position, the throttling element 31 takes care that the same or nearly the same pressure prevails in the cylinder spaces 19 and 21. However, the throttling element only passes so small liquid quantities per unit time that it is not able to prevent the change of pressure in the cylinder space 21 when the piston is in its end positions. The effect of the throttling element 31 to equalize the pressure in the cylinders 19 and 21 possesses significance with regard to the starting ability of the machine when the piston is positioned between its end positions and the distribution means has slipped into a position such that neither opening 18 or 20 is open. The pressure action areas on the piston on one hand and on the distribution means on the other hand are such that when the high pressure prevails in cylinder space 10 and in cylinder space 11 different pressures tend to become established in cylinder spaces 19 and 21, which at their equalization through the throttling element 31 set the distribution means 3 in motion, whereby one of the openings 18 and 20 opens and causes the machine to operate in desired manner.

At the tool (4) end of the piston 2 a chamber 32 has been provided, from which bore 33 leads to the free atmosphere. Correspondingly, at the other end of the piston there is a chamber 34, from which a bore 35 leads to the free atmosphere. When a device according to the invention is applied as a percussion mechanism of a rock drill, the said unpressurized breathing chambers are highly useful for the conduction of flushing fluid from the rear part of the machine through the piston along the flushing pipe extending into the drill rod. No sealing difficulties are the encountered between the flushing pipe and the pressurized cylinder spaces, which implies that costs are saved in the manufacturing of the flushing tube.

A pressure accumulator may be connected not only to the high pressure duct but also to other liquid passages in the percussion machine, such as e.g. the low pressure duct 8.

Other embodiments consistent with the claims are also considered to fall within the sphere of the invention.

We claim:

1. Improvement in a hydraulically driven percussion device of the type for operation from a source of high pressure fluid and comprising a piston reciprocally movable within a body for striking against a tool, said piston defining with reference to the body two cylindrical chambers within which the piston moves, one of which chambers continuously communicates with the high pressure fluid, and distribution means for alternatingly connecting the other of said chambers to the high pressure fluid supply and a low pressure fluid supply, wherein the improvement comprises means for venting both ends of the piston to the low pressure fluid supply, said distribution means being located within one of the chambers and comprising a sleeve surrounding at least a portion of said piston, in order to move into a position such that movement of the piston directed towards the tool becomes possible, is controlled by means of grooves provided in the piston and in the body when the piston is in its end position farthest removed from the tool and only on condition that the pressure of the high pressure fluid supply exceeds a pressure set with an adjustable means incorporated in the body.

2. A device as in claim 1 wherein said adjustable means comprises a throttling valve which provides communication between said one chamber-inserted in its place and the chamber within which the distribution means is located.

* * * * *